US005662289A

United States Patent [19]

Ujita et al.

[11] Patent Number: 5,662,289

[45] Date of Patent: Sep. 2, 1997

[54] WINDING APPARATUS FOR COILS FORMED OF WIRE AND FILM IN WHICH STRIPS OF FILMS ARE HELD AT EACH END BY RESPECTIVE CHUCKS

[75] Inventors: Minoru Ujita, Saitama; Takafumi Kakiuchi, Chiba; Masahiro Otsuka, Aichi; Takayuki Nakamura, Tokyo, all of Japan

[73] Assignee: Sony Corporation, Tokyo, Japan

[21] Appl. No.: 420,684

[22] Filed: Apr. 12, 1995

[30] Foreign Application Priority Data

Apr. 21, 1994 [JP] Japan ..... 6-105953

[51] Int. Cl.[6] ..... B65H 81/02

[52] U.S. Cl. ..... 242/445; 242/444.5

[58] Field of Search ..... 242/445, 444.5

[56] References Cited

U.S. PATENT DOCUMENTS

| | | | |
|---|---|---|---|
| 4,168,808 | 9/1979 | Santi et al. | 242/444.5 |
| 5,224,257 | 7/1993 | Murakoshi et al. | 242/444.5 |
| 5,360,178 | 11/1994 | Arnold | 242/445 |

FOREIGN PATENT DOCUMENTS

| | | |
|---|---|---|
| 0331510 | 7/1930 | United Kingdom . |
| 0389451 | 6/1931 | United Kingdom . |
| 0404690 | 1/1934 | United Kingdom . |
| 0695618 | 8/1953 | United Kingdom . |
| 0917973 | 2/1963 | United Kingdom . |

*Primary Examiner*—Daniel P. Stodola
*Assistant Examiner*—Emmanuel M. Marcelo
*Attorney, Agent, or Firm*—Jay H. Maioli

[57] ABSTRACT

A winding apparatus and a winding method for positioning a leading end of a film layer with high precision. The film is loaded at a position away from a winding position for winding the film around a bobbin and the leading end of the film is brought into contact with the bobbin by using a retainer. At the same time, to control the length of the film to be wound to improve reproducibility of the shape of a transformer a drag chuck is provided, and the drag chuck is controlled through a servo control.

5 Claims, 15 Drawing Sheets

WINDING APPARATUS FOR COILS FORMED OF WIRE AND FILM IN WHICH STRIPS OF FILMS ARE HELD AT EACH END BY RESPECTIVE CHUCKS

BACKGROUND OF THE INVENTION

1. Field of the Invention

The present invention relates to a winding method and a winding apparatus for adding layers to a transformer. More particularly, the present invention relates to a method and an apparatus for alternatively winding a linear wire and a film web in the form of multiple layers for a bobbin type transformer such as a flyback transformer.

2. Description of the Related Art

Japanese Patent Application Laid-Open Nos. Hei 5-3128 and Hei 5-101961 disclose the following conventional techniques in the field to which the present invention pertains.

Japanese Patent Application Laid-Open No. Hei 5-3128 relates to the manufacture of a compact winding device fit for mass-production by a method wherein a core holding mechanism is composed of intermittently rotated frame body and multiple core fixing spindles rotatable and projecting from the periphery of the frame body respectively provided with a specific wire winding mechanism and a sheet winding mechanism.

The barrel of a core is alternately wound up with a conductive wire and an insulating sheet using a core holding mechanism, a wire winding mechanism and a sheet winding mechanism so as to form a laminated layer coil. In such a device, the core holding mechanism is composed of an intermittently rotated frame body and multiple core fixing spindles rotatable and projecting from the periphery of the frame body. A wire winding mechanism for winding the wire around the terminal of the core in every layer winding step is arranged in the position opposing to one of the spindles while a sheet winding mechanism is arranged in the position opposing to one of the other spindles.

Japanese Patent Application Laid-Open No. Hei 5-101961 provides appartus to rapidly supply an insulation film tape to a coil bobbin engaged with a spindle.

An insulation film tape from a supply source is necessarily processed, its end is made to approach and remain near a tape winding part. Then, when a coil bobbin is moved to the winding part, it is supplied to a predetermined position of the bobbin, and fusion-bonded. It is cut in a predetermined length to obtain a cut tape. Thereafter, the bobbin is rotated, a rear nip for holding tape is moved together with the tape and wound.

As disclosed in Japanese Patent Application Laid-Open No. Hei 5-3128, in particular, in the technique in forming multiple laminated layers by alternatively winding a wire and a sheet, a change in thickness of the winding layer in the winding step to the bobbin is accommodated with a mechanism for pressing the film at a certain pressure with the fusion-bonding mechanism. Also, as disclosed in Japanese Patent Application Laid-Open No. Hei 5-101961, in the winding method, the film is cut after the film is pressed to the bobbin by the fusion-bonding mechanism. Thereafter, the bobbin is rotated.

However, in the conventional fusion mechanism, it is insufficient to press the film to a certain extent and it is difficult to accurately fusion-bond the film to a preselected position. For this reason, there is a problem that the shape of the final transformers is considerably upstable.

Also, if the film is cut after the film has been pressed to the bobbin by the fusion-mechanism, it is impossible to control the length of the film to be wound, due to the varying thickness of the winding layer. As a result, there is a problem that the shape of the final transformers becomes irregular, thus decreasing the energy transforming efficiency.

SUMMARY OF THE INVENTION

In order to overcome the above-noted defects, an object of the present invention is to provide a winding apparatus and a winding method for positioning a leading end of the film with high precision by using a system in which the film is loaded at a position away from a winding position of the film when the film is wound around the bobbin and the leading end of the film is brought into contact with the bobbin by using a retainer section and for controlling a length of the film to be wound to improve reproducibility of the shape of a transformer by using a drag chuck and controlling the drag chuck through a servo control.

According to the present invention, it is possible to load the film at a predetermined position irrespective of the winding layer by loading the film at the position away from a winding position of the film when the film is wound around the bobbin. Also, the leading end of the film is brought into pressing contact with the bobbin by using the retainer member to thereby perform the positional precision of the leading end of the film upon the film fusion-bonding and to improve reproducibility.

As a result, according to the present invention, the film is loaded at a position away from the film winding position when the film is wound around the bobbin and the leading end of the film is brought into pressing contact with the bobbin by using the retainer member so that it is possible to perform the film winding without any loosening and to perform the precise positioning of the film leading end. Also, according to the present invention, the drag chuck is provided and the positioning is carried out through the servo control whereby the film length is controlled and the reproducibility of the shape of the transformer may be improved.

DETAILED DESCRIPTION OF THE PREFERRED EMBODIMENTS

Figure 1:
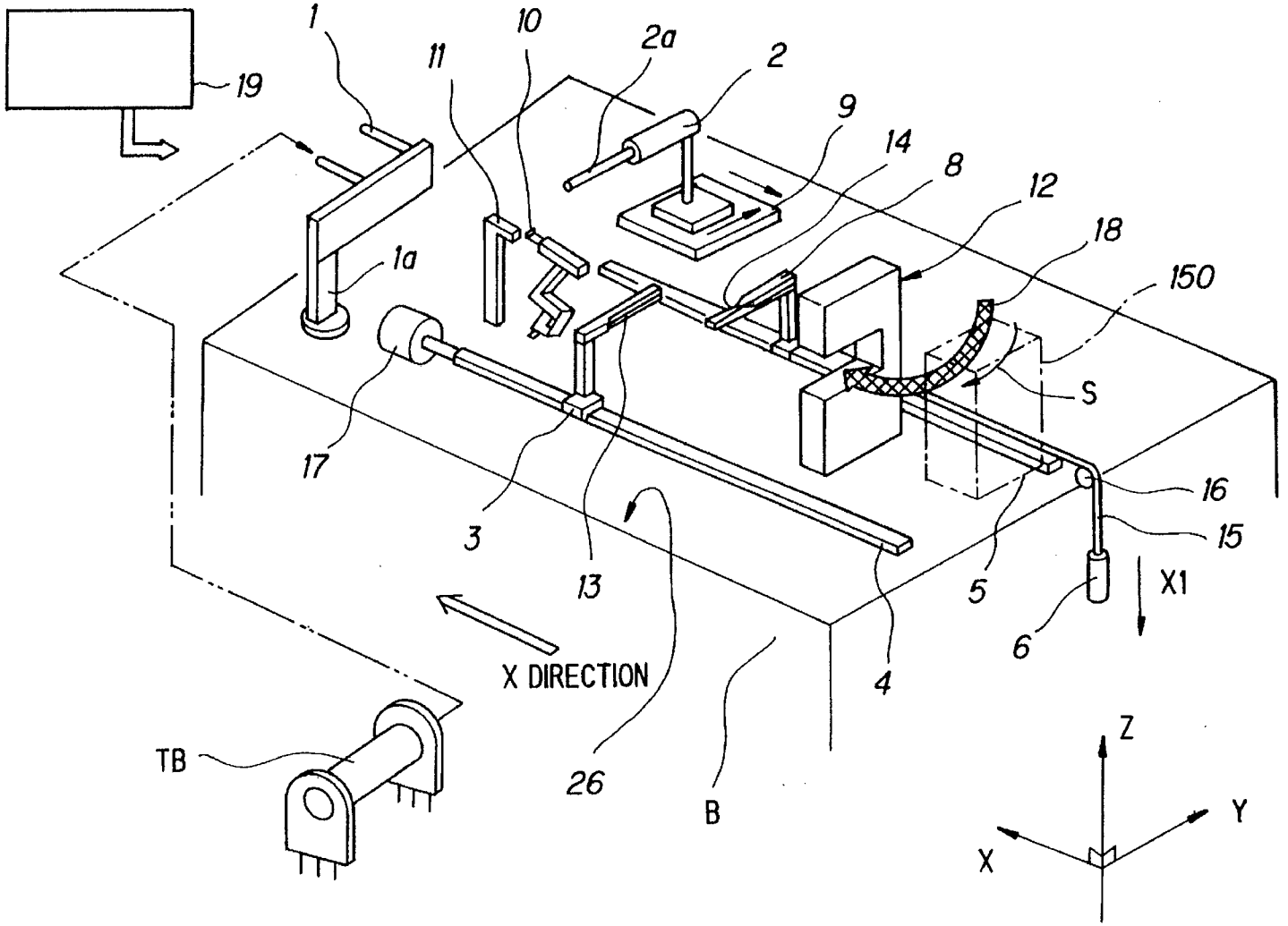
FIG. 1 is a perspective view showing a winding apparatus according to a preferred embodiment of the invention.

A preferred embodiment of the present invention will now be described by way of example with reference to the accompanying drawings.

Various details of the invention may be changed without departing from its spirit nor its scope. Furthermore, the following description of the embodiment according to the present invention is provided for the purpose of technical illustration only, and not for the purpose of limiting the invention as defined by the appended claims and their equivalents.

An outline of a wire winding apparatus according to the preferred embodiment of the invention will now be described with reference to FIG. 1. The winding apparatus is used to form multiple laminated layers by alternatively winding a linear wire and a film for a bobbin type transformer such as a flyback transformer (FBT).

A rotary loader 1 has, for example, two bobbin insertion rods. One of the bobbin insertion rods is used for a loading part for a full bobbin around which the wire and the film 18 have been already wound. The other one is used for a loading part for an empty bobbin around which the wire and the film 18 have never been wound by the operator. The rotary loader 1 is mounted on a base B through a rotary base 1*a* which is to be rotated according to a command from a numerical controller. 19.

The numerical controller 19 is a sequencer which can generate an electric signal for totally controlling this system. The numerical controller controls all the objects to be controlled in the main system including the rotary loader 1, a servo motor 17 and the like to be described later.

An XY table 9 is provided on the base B and is so constructed as to move a winder 2 and the like provided on its top surface in a plane in parallel with the base B in a horizontal direction (X and Y directions).

The winder 2 is disposed on the XY table 9 and is so constructed that a shaft 2*a* may be rotated by the servo motor. A bobbin TB of the transformer may be affixedly mounted on the shaft 2*a*.

A film loading mechanism will now be explained.

The film loading mechanism loads the film 18 into a position remote from the film winding position when the film 18 is wound around the bobbin TB.

A drag chuck guide 4 is a linear guide which is fixed to the base B so that its longitudinal direction is coincident with the X direction.

A retainer chuck guide 5 is also a linear guide which is fixed to the base B so that its longitudinal direction is coincident with the X direction.

A drag chuck 13 is composed of two claws and is so constructed as to chuck the film 18 by an action of a cylinder. The drag chuck 13 draws the film 18 in a direction (X direction) perpendicular to the axis of the bobbin.

A drag chuck body 3 is provided at its upper portion with the drag chuck 13 and is so constructed as to slidingly move in the X direction while engaging with the chuck guide 4.

The servo motor 17 is a DC motor in which a ball screw is fixed to its shaft. The servo motor 17 is used to move and position the drag chuck body 3 to a desired position on the chuck guide 4 under the servo control from the numerical controller 19.

A retainer chuck 14 is composed of two claws so as to chuck a rear end portion of the film under an action of a cylinder. The retainer chuck 14 is used to grip the rear end of the film 18 which has been cut in a predetermined length by a cutter 12.

A retainer chuck body 8 is provided at its upper portion with the retainer chuck 14 so as to move in the X direction while engaging with the retainer chuck guide 5.

A belt 15 is a strip member having a low flexibility. Its one end is engaged with the retainer chuck body 8 and the other end is engaged with a weight 6. In other words, the retainer chuck 14 is biased through the belt 15 by the weight 6 in a direction opposite to the X direction in which the film 18 is loaded.

Also, the belt 15 is suspended from a belt pulley 16 located midway on the edge of base B. so as to change its direction from the extension in the horizontal direction to the extension in the vertical direction.

The cutter 12 is provided with a film cutting section and a grip portion for temporary fixing the film 18. The film 18 may be introduced through the interior of the cutter 12 so that it may be cut. The film 18 may be temporary held by the grip section in order to prevent the accidental movement of the film 18 which has been cut.

As described above and shown in FIG. 1, the film loading mechanism for the film 18 is composed of the drag chuck 13, the film cutter 12 and the retainer chuck 14.

A mechanism of a section for winding the film will now be described.

A welder 10 is provided with a mechanism for moving in a Z direction and a Y direction and a film heating section at its tip end so that the film 18 that has been wound around the bobbin TB may be welded.

The film 18 to be wound around the bobbin TB is caused to pass through a tension controlling means (not shown) from a film introduction direction S into the X direction (in which the film 18 is to be loaded).

Structures of the XY table 9 and the winder 2 will now be described in more detail with reference to FIG. 3. Y guide rails 25-1 and 25-2 are fixed to the base B, respectively, for slidingly moving four Y guide blocks 34 provided on the Y table 26.

A Y screw 23 is a ball screw supported rotatably about an axis on the base B. A pulley 23*a* is mounted on the Y screw 23, and a belt 23*b* is laid around the pulley 23*a* so that a torque of a rotary shaft of a Y servo motor 21 is transmitted to the Y screw 23 through a pulley 21*a*.

The Y servo motor 21 is a DC servo motor which serves as a power source for driving a Y table 26 in the Y direction and is controlled by the above-described numerical controller 19.

A Y ball nut 24 is threadedly engaged with the Y screw and is fixed to the Y table 26.

The Y table 26 is slidingly moved in the Y direction in accordance with the rotation of the Y screw 23 along the Y guide rails 25-1 and 25-2 by the four Y guide blocks 34 fixed to a bottom surface of the Y table 26.

X guide rails 29-1 and 29-2 are linear guide rails fixed on the Y table 26.

An X servo motor 20 is a DC servo motor which serves as a power source for driving an X table 28 in the X direction and is controlled by the above-described numerical controller 19.

An X screw 22 is a ball screw which is rotatably supported on the Y table 26. A pulley 22*a* is mounted on the X screw 22 and a belt 22*b* is laid around the pulley 22*a* so that the torque of a rotary shaft of the X servo motor 20 is transmitted to the X screw 22 through a pulley 20*a*.

The X table 28 is slidingly moved in the X direction in accordance with the rotation of the X screw 22 along the X guide rails 29-1 and 29-2. A nut for generating a driving power is provided on the bottom surface of the X table while threadedly engaging with the X screw 22. Also, four X guide blocks 35 are provided for restricting the sliding direction.

A post 27 is fixed to the X table 28 and carries a winder 2 at its upper end on the X table 28. The height of the post 27 is determined so as to support a winder spindle 2*a* at a desired position. It should be noted that it is unnecessary to adjust the height.

A spindle motor 30 is a DC servo motor which serves as a power source for rotating the winder spindle 2*a* and is controlled by the numerical controller 19. A pulley 30*a* is fixed to the output shaft. The spindle servo motor 30 is driven to rotate the bobbin TB mounted around the winder spindle 2*a* so that the wire and the film may be wound around the bobbin.

A winder pulley 31 is mounted on the winder spindle 2*a*. A belt 30*b* is laid between the winder pulley 31 and the pulley 30*a* mounted on the spindle motor 30.

A structure of the retainer chuck body 8 shown in FIG. 1 will be described with reference to FIGS. 4 and 5.

The retainer chuck 14 has claw portions 14*a* and 14*b* for gripping the film 18.

Figure 4:
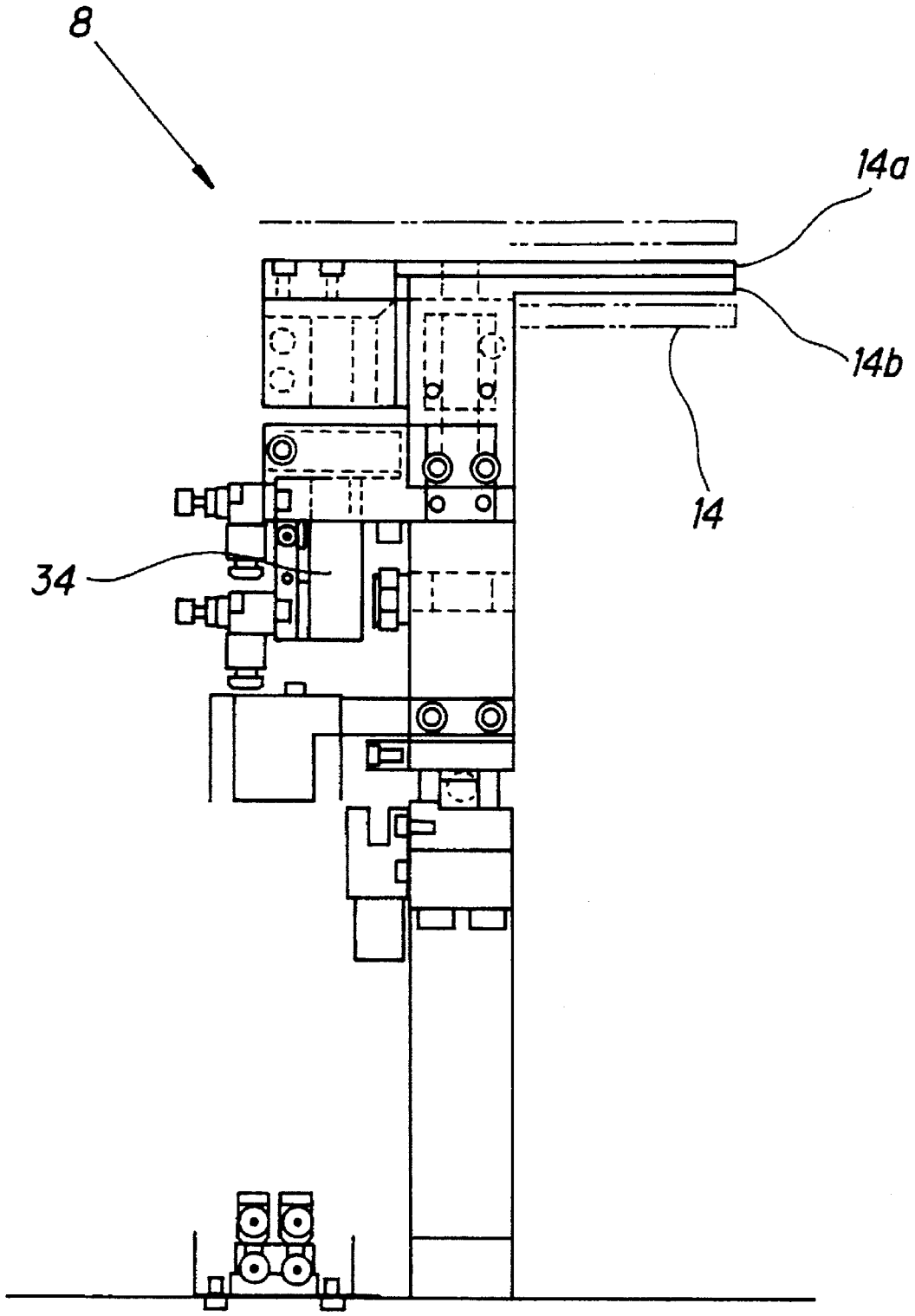
FIG. 4 is a frontal view showing a retainer chuck and a chuck cylinder.

The retainer chuck cylinder 34 shown in FIG. 4 is a cylinder which serves as a power source for opening/closing the claw portions 14*a* and 14*b* of the retainer chuck 14.

Figure 5:
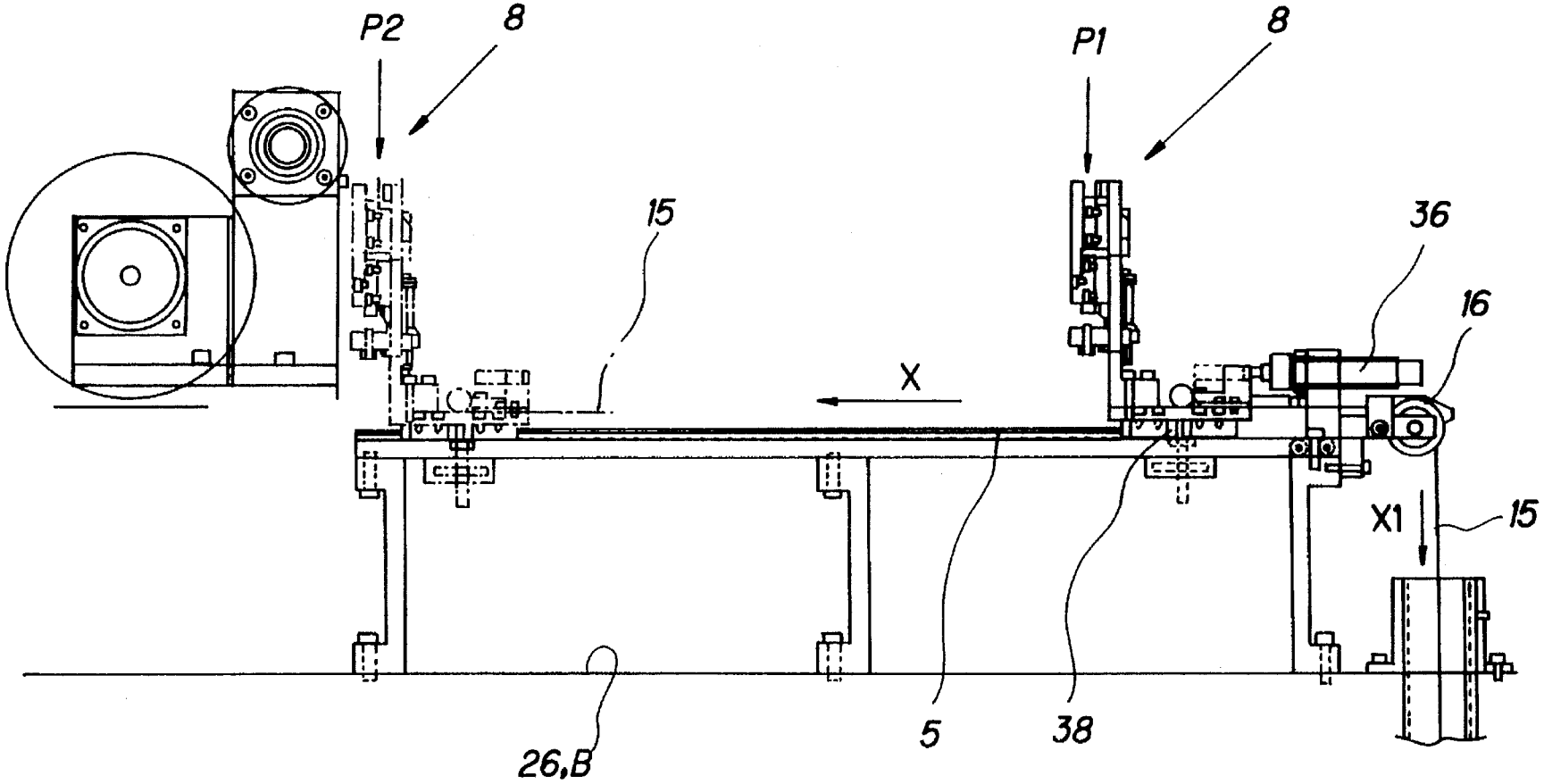
FIG. 5 is a side elevational view showing the retainer chuck and a retainer chuck guide.

As shown in FIG. 5, the retainer chuck body 8 is fixed to a chuck guide block 38 and is slidingly movable in the X direction along the retainer chuck guide 5. The belt 15 is mounted directly on the retainer chuck body 8 and is changed in direction by the pulley 16. The retainer chuck body 8 is biased in the X1 direction by the weight 6 shown in FIG. 1.

In FIG. 5, the retainer chuck body 8 located at a position P1 is depicted by solid lines and the retainer chuck body 8 which has been moved to a position P2 is depicted by dotted lines.

An air absorber 36 shown in FIG. 5 is a shock dampening mechanism which has flexibility in its axial direction and an attenuation property. The air absorber 36 is so arranged as to come into contact with a part of the retainer chuck body 8 at a predetermined position when the retainer body 8 is moved in the X1 direction and dampens the shock when the retainer chuck body 8 is moved and collided with the air absorber 36. At the same time, the air absorber 36 serves as a mechanical stop for preventing the retainer chuck body 8 from moving in the X1 direction beyond the predetermined position.

Figure 8:
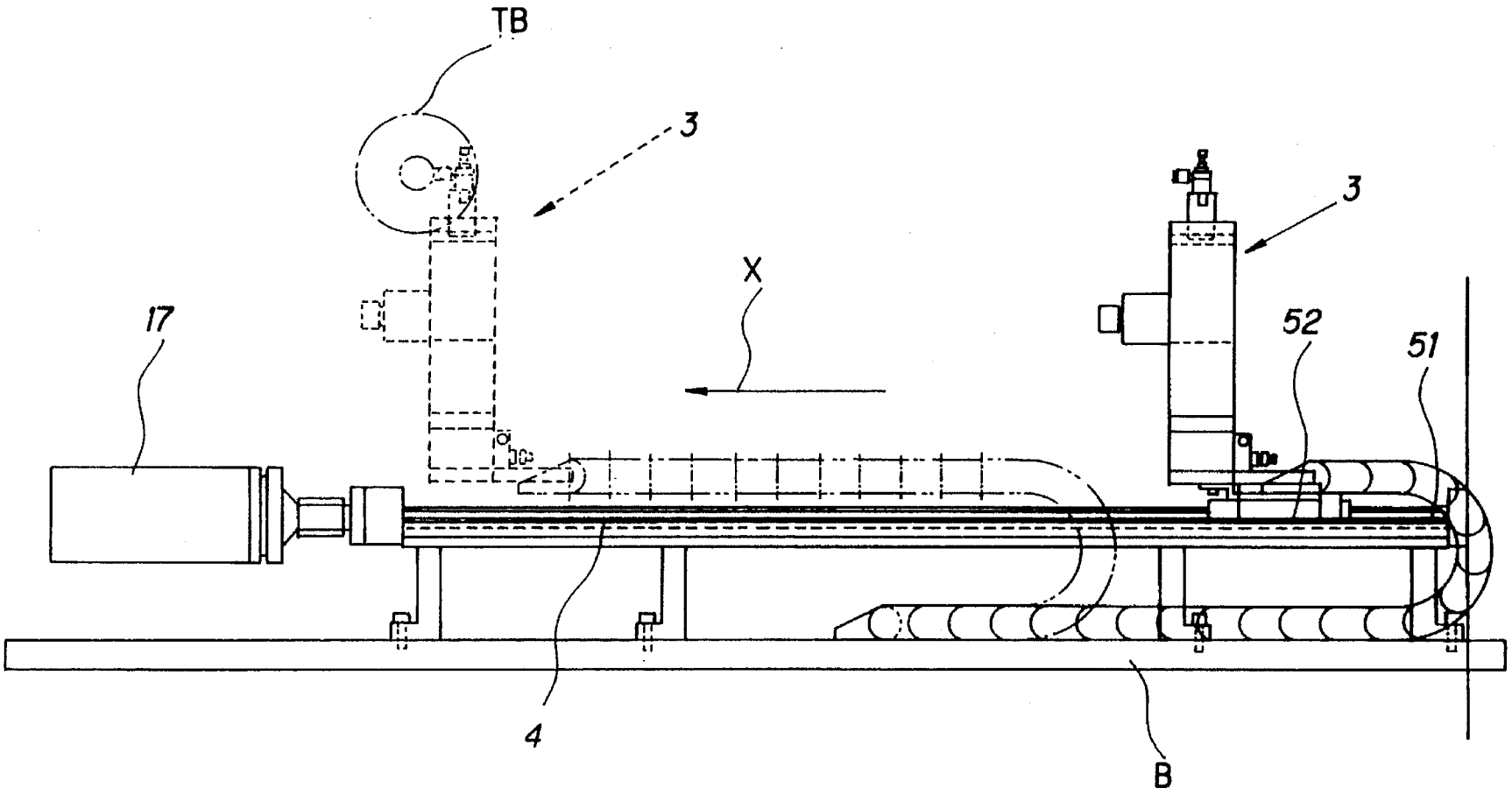
FIG. 8 is a side elevational view showing a drag chuck body and a drag chuck guide.
Figure 9:
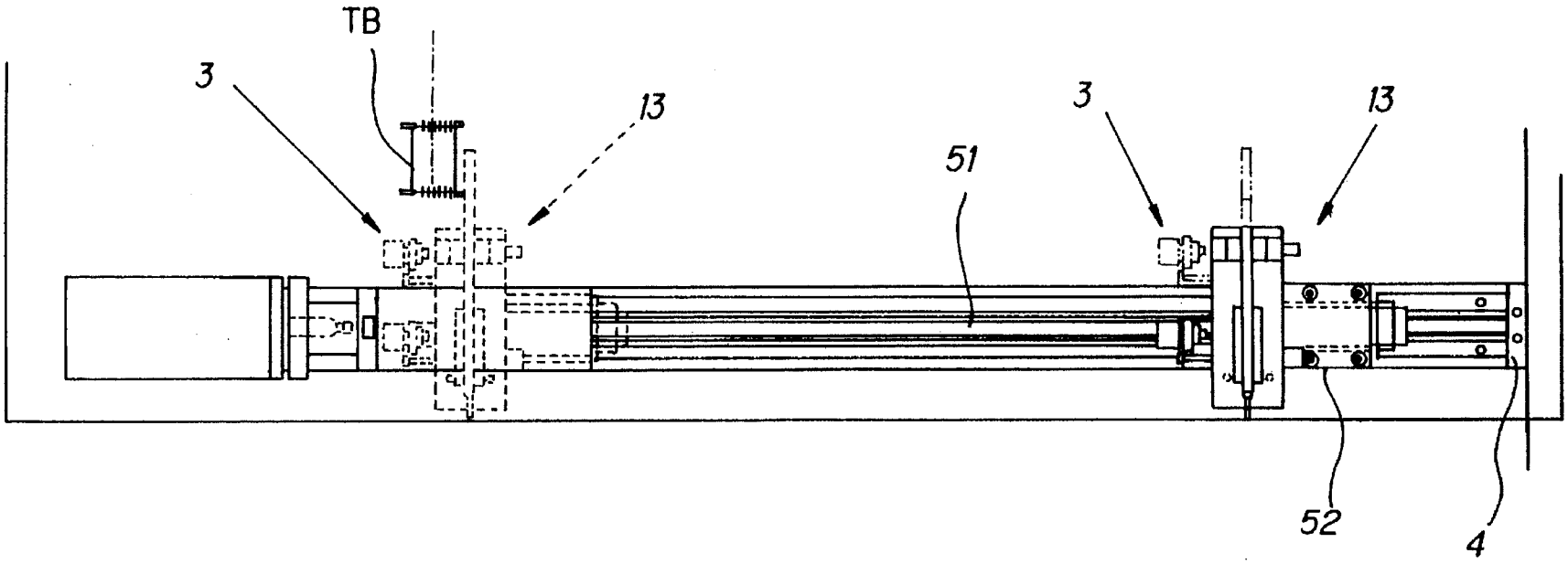
FIG. 9 is a plan view showing the drag chuck body and the drag chuck guide.
Figure 10:
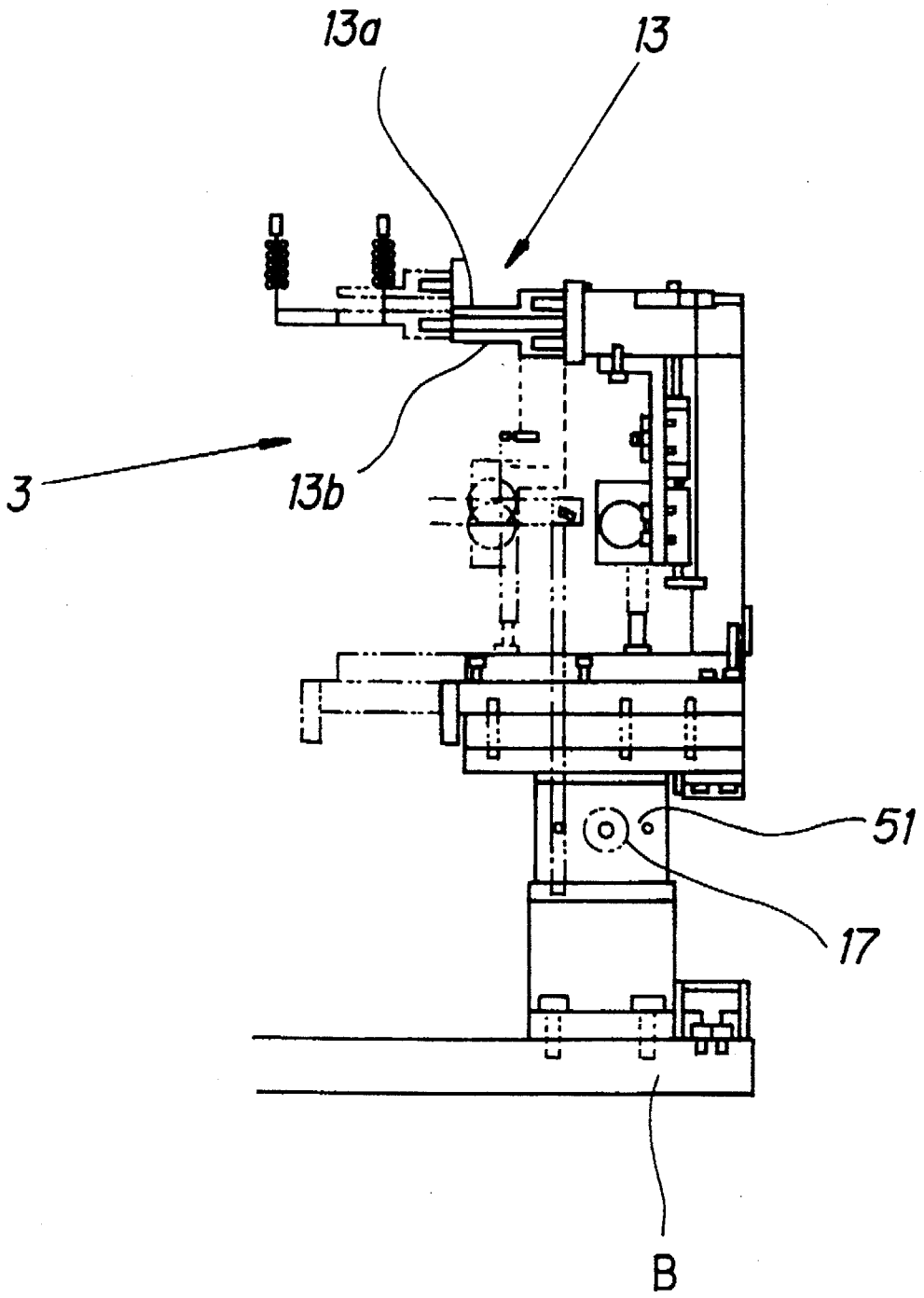
FIG. 10 is a frontal view showing the drag chuck body and the drag chuck guide.

A peripheral mechanism of the drag chuck 13 shown in FIG. 1 will now be described with reference to FIGS. 8 through 10.

A servo motor 17 is a DC servo motor which serves as a power source for a drag chuck ball screw 51 and is controlled by the numerical controller 19.

The drag chuck ball screw 51 is disposed in parallel with the drag chuck guide 4 on the base B and is rotatably supported thereon. The drag chuck ball screw 51 is mounted directly on an output shaft of the drag chuck servo motor 17.

A drag chuck guide block 52 is a linear guide block and is connected to the drag chuck guide 4 to be slidable in the X direction. A nut which is threadedly engaged with the drag chuck ball screw 51 is fixed to the block 52 which is moved in the X direction in accordance with the rotation of the chuck ball screw 51.

The drag chuck body 3 is fixed to the drag chuck guide block 52 and is provided at its upper portion with the drag chuck 13. The drag chuck 13 is constructed so as to grip the film 18 shown in FIG. 1 and the claw portions 13*a* and 13*b* shown in FIG. 10 are constructed so as to open/close up and down by the action of the cylinder for the drag chuck.

The cylinder for the drag chuck is not shown in the drawing but may be constructed in the same manner as the mechanical portion for opening/closing the retainer chuck.

A mechanism of the welder 10 shown in FIG. 1 will now be explained with reference to FIGS. 6 and 7.

Figure 6:
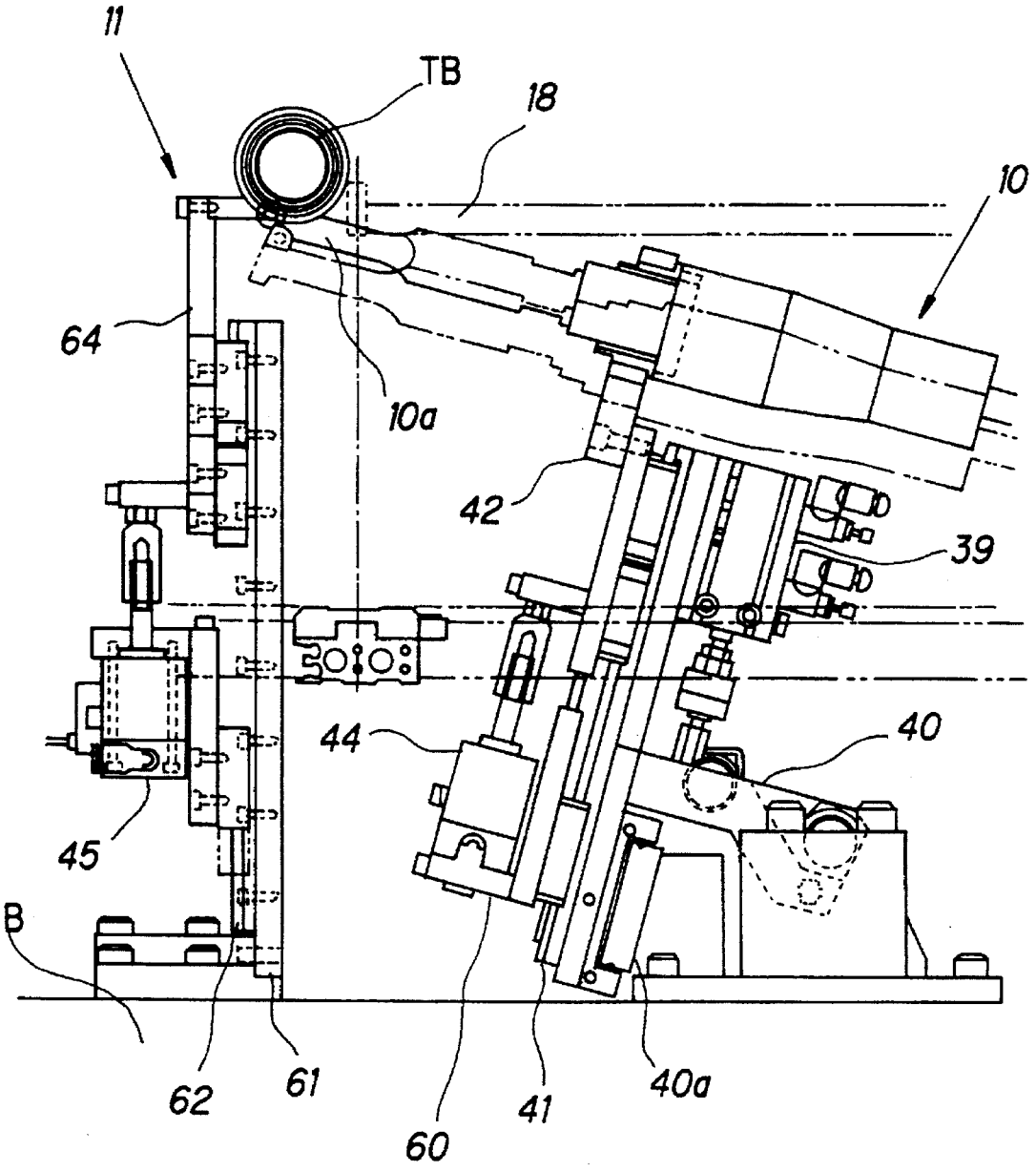
FIG. 6 is a side elevational view showing a bobbin, a welder and a film retainer section.

A welder support member 40 of the welder 10 is a member which is in the form of a T-shape in side elevational view and is so constructed as to be movable in the vertical direction relative to the paper surface of FIG. 6 by the guidance of a linear guide 40*a* by a cylinder (not shown).

A welder up-and-down moving cylinder 39 is an air cylinder which serves as a power source for moving the welder 10 up and down.

A welder up-and-down guide rail 41 is a linear guide rail connected to the welder support member 40 and is disposed substantially vertically or obliquely at a predetermined angle with respect to the longitudinal direction of the apparatus.

A welder downwardly moving block 60 is engaged with a piston portion of a welder up-and-down cylinder 39 and is also engaged with a guide block slidably engaged with the welder up-and-down guide rail 41.

A welder upwardly moving block 42 is a block which is carried on the linear guide block slidably engaged with the welder up-and-down guide rail 41.

A welder contact pressure adjusting air spring 44 is an air cylinder whose internal pressure is controlled by an air regulator (not shown) and which is not shortened unless a force exceeding a predetermined level is applied between the cylinder portion and the piston portion. Of course, other means may be used if it may control the contact pressure of the welder against the bobbin. Any other mechanism which can serve as a predetermined pressure controlling means may be used. The cylinder portion of the welder contact pressure adjusting air spring is fixed to the welder downwardly moving block 60 and the piston portion thereof is fixed to the welder upwardly moving block 42. Thus, the welder contact pressure adjusting air spring is constructed so as to indirectly connect the welder downwardly moving block 60 and the welder upwardly moving block 42.

The welder upwardly moving block 42 supports the welder 10 at its upper end. The tip end of the welder 10 is the heating means for fusing the film 18 shown in FIG. 1.

A mechanism of the film retainer portion 11 will now be described with reference to FIGS. 6 and 7. The film retainer portion 11 is used to press the tip end of the film 18 to the bobbin TB.

The film retainer portion 11 is disposed in correspondence with the above-described welder 10. A film retainer support member 61 is in the form of an L-shape in side elevational view and is fixed at its shorter edge to the base B.

Figure 7:
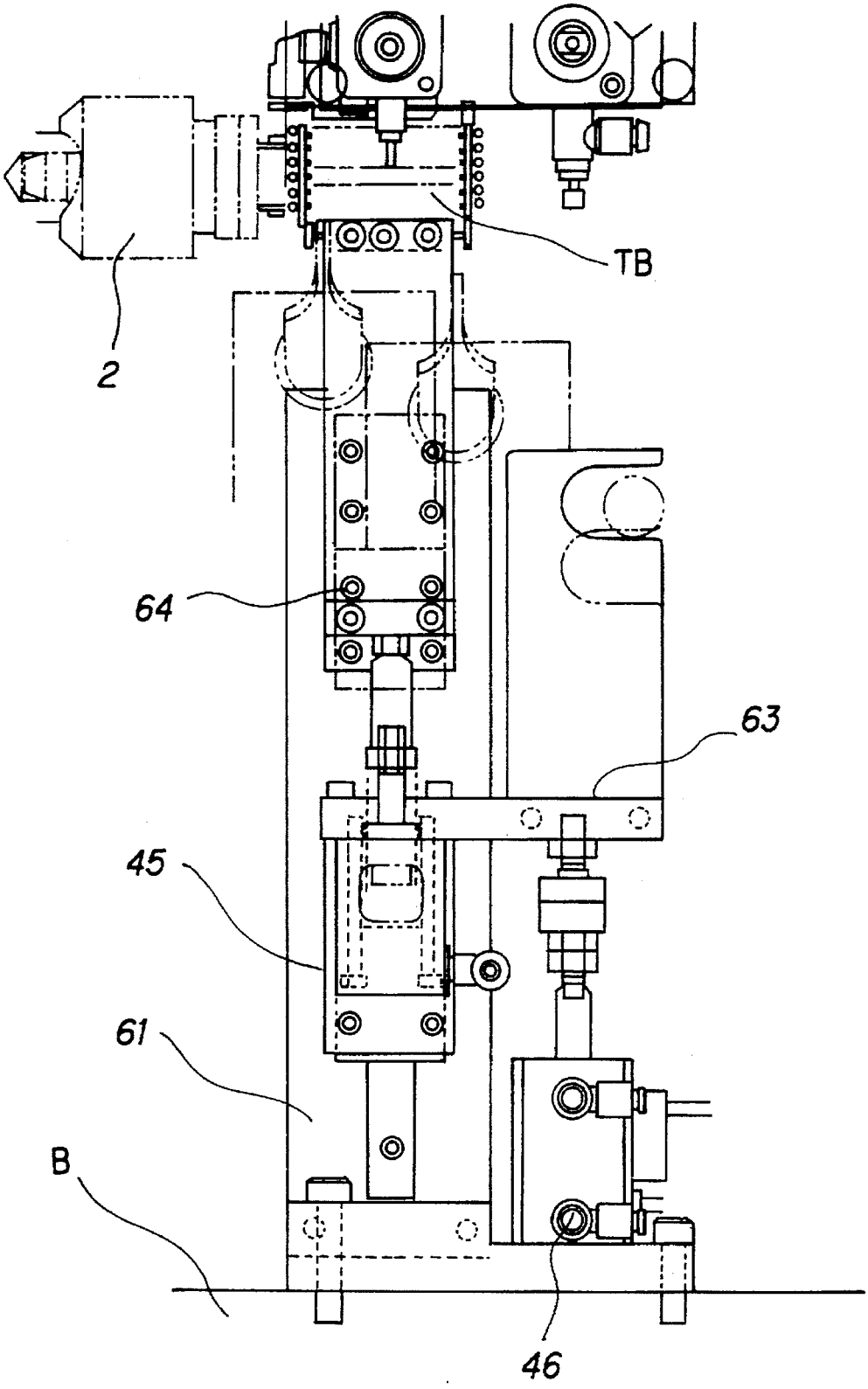
FIG. 7 is a frontal view showing the bobbin and the film retainer section.

A film retainer up-and-down moving cylinder 46 shown in FIG. 7 is an air cylinder which serves as a power source for moving a film retainer pressing block 64 up and down with its cylinder portion being fixed to the base and with its rod being mounted on a film retainer lowering block 63.

A film retainer up-and-down guide rail 62 shown in FIG. 6 is a linear guide rail provided along a long edge portion of the film retainer support member 61 and its longitudinal direction is oriented in the vertical direction of the apparatus.

The film retainer lowering block 63 is engaged with a piston portion of the film retainer up-and-down moving cylinder 46 and is also engaged with a guide block which is slidably engaged with the film retainer guide rail 62.

The film retainer pressing block 64 is a block which is carried on a linear guide block slidably engaged with the film retainer up-and-down guide rail 62. The upper end of the block 64 is arranged so as to pressingly contact the film, shown in FIG. 1, against the bobbin TB.

A film retainer contact pressure adjusting air spring 45 is an air cylinder whose internal pressure is controlled by an air regulator (not shown) and which is not shortened unless a force exceeding a predetermined level is applied between the cylinder portion and the piston portion of the air spring 45. Of course, other means may be used if it may control the contact pressure of the film retainer against the bobbin. Any other mechanism which can serve as a predetermined pressure controlling means may be used.

The cylinder portion of the film retainer contact pressure adjusting air spring 45 is fixed to the film retainer lowering block 63 and the piston portion thereof is fixed to the film retainer pressing block 64 so that the film retainer lowering block 63 and the film retainer pressing block 64 are indirectly connected to each other. As shown in FIGS. 6 and 7, the bobbin TB set on the winder spindle 2*a* of the winder 2 has a positional relationship close to the film retainer pressing block 64.

The wire feeding mechanism is located close to the winder 2 shown in FIG. 1. The mechanism feeds the wire to the bobbin TB.

The operation and function of the foregoing embodiment will now be explained with reference to a flowchart shown in FIG. 2.

First of all, the operator loads an empty bobbin TB to an empty bobbin loading portion of the rotary loader 1 shown in FIG. 1 and generates an operation start command from an operational panel (not shown) (Step S5).

Thus, the rotary loader 1 is rotated and moved so that the empty bobbin TB is in parallel with an axis of the winder spindle 2*a* of the winder 2 (Step S6).

Then, the XY table 9 is moved and the empty bobbin TB is loaded from the rotary loader 1 to the winder spindle 2*a* (Step S7).

Figure 3:
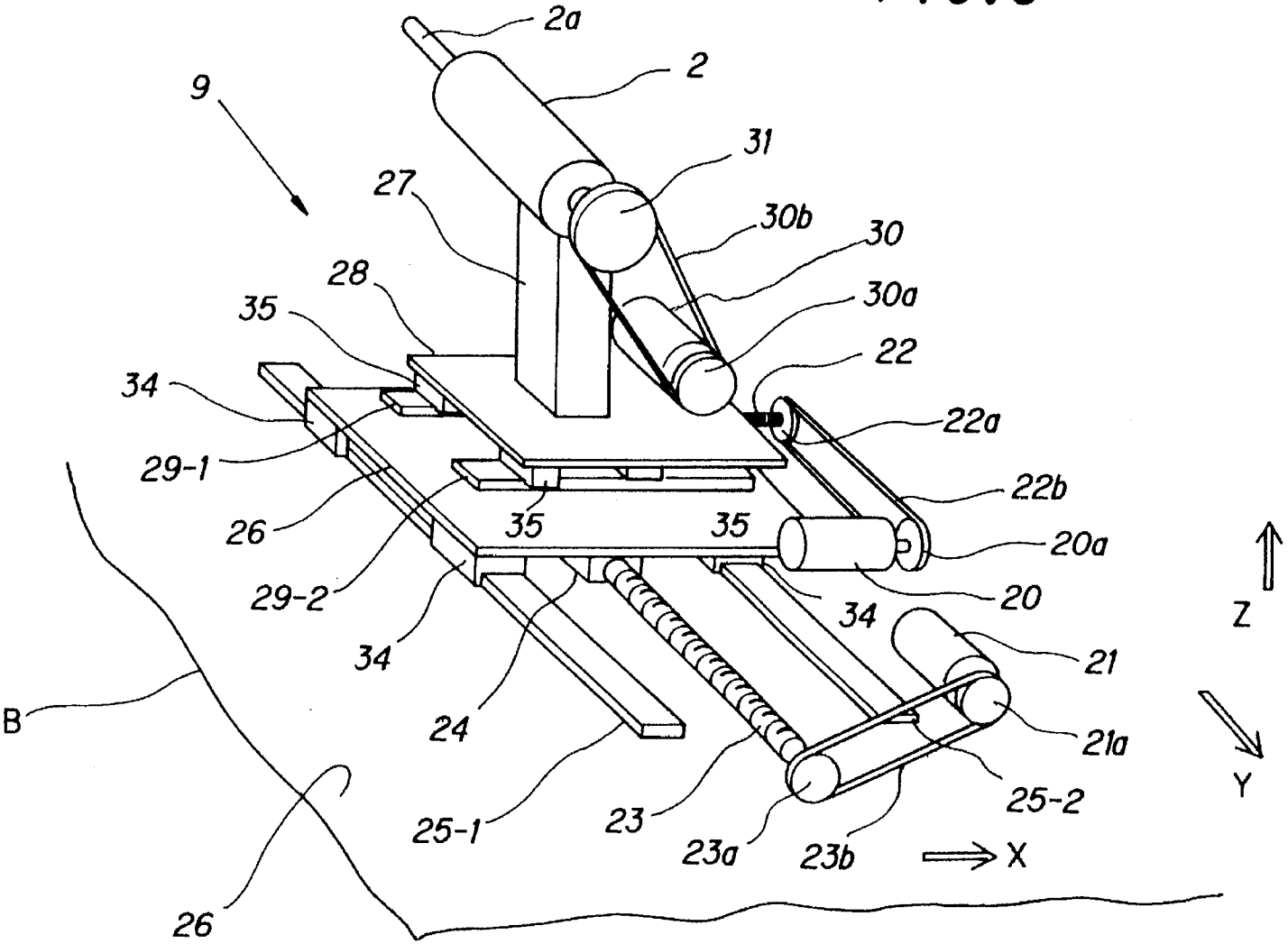
FIG. 3 is a perspective view showing a winder and its XY table shown in FIG. 1.

The winder spindle 2*a* is rotated for winding one turn of wire around the empty bobbin TB by using the wire feeding mechanism (not shown) and the Y table 26 of the XY table 9 shown in FIG. 3 is moved incrementally to perform a traverse process.

By the "traverse" process the winder spindle 2*a* is again rotated for winding a second turn of wire adjacent to the first turn. In general, the Y table 26 is driven so that the surface of a layer of wire becomes flat when the winding corresponding to one layer is completed.

Subsequently, the drag chuck 3 shown in FIG. 1 is moved to the cutter 12 (Step S1).

Since the leading end of the film 18 shown in FIG. 1 is located at the cutter 12, the leading end portion of the film 18 is clamped by the chuck 13 (Step S2). In this case, the retainer chuck body 8 stops adjacent to the cutter 12.

Thereafter, the drag chuck 13 is moved by the servo motor 17 to a predetermined position close to the winder 2 (Step S3). The "predetermined position" means a position where a length of the film from the leading end of the film 18 that has been drawn by the drag chuck 3 to the portion which will be cut by the cutter 12 is coincident with a distance that is needed for one winding turn of the film around the bobbin TB. Accordingly, since the winding step layers around the bobbin TB have different lengths, the predetermined position to which the drag chuck 3 is to move is changed for every step layer. More particularly, since a radius of the winding of the film 18 is elongated for every layer due to the affects of the thickness of the wire, the wire should be moved closer to the winder 2 for every layer.

Subsequently, after the film 18 has been clamped by the retainer chuck 14, the film 18 is cut by the cutter 12 (Step S4).

Subsequently, the drag chuck 13 is moved close to the winder 2 and further moved just below the winder 2 (Step S8). Thus, the film 18 is loaded at a position away from the winding position of the film 18.

At this time, the retainer chuck body 8 is drawn by a predetermined force in the X1 direction by the weight 6, and the retainer chuck 14 is also drawn in the X direction and is moved in the X direction by the movement of the drawn chuck 13. Then, the retainer chuck 14 acts to impart a suitable tension to the film 18 and to prevent loosening.

Subsequently, the film 8 is brought into contact with the empty bobbin TB at a predetermined pressure by the film retainer 11 (Step S9). The action of raising the film retainer 11 shown in FIG. 1 causes the film retainer up-and-down moving cylinder 46 shown in FIGS. 6 and 7 to extend, thereby upwardly moving the film retainer lowering block 63. The action of the film retainer pressing air spring 45 causes the film pressing block 64 to rise, as a result of which the tip end of the film pressing block 64 causes the film 18 to come into contact with the bobbin TB at a predetermined pressure.

Since the air spring regulator is adjusted so that the air spring 45 is set at 0.5 kgf to 2.0 kgf in which the retraction is started, the above-described predetermined pressure is in the range of 0.5 kgf to 2.0 kgf.

Subsequently, the welder 10 shown in FIG. 6 is raised and the film 18 is fused to the bobbin TB (Step S10).

In the operation of raising the welder 10 shown in FIG. 6, the welder up-and-down moving cylinder 39 is retracted so that the welder lowering block 60 is raised, and the welder upwardly moving block 42 is raised by the welder contact pressure air spring 44, as a result of which the tip end 10*a* of the welder 10 may fusion-bond the film 18 to the bobbin TB at the predetermined pressure.

Also, since the air spring regulator (not shown) is adjusted so that the retraction is started at 0.5 kgf to 2.0 kgf of the air spring, the predetermined pressure is in the range of 0.5 kgf to 2.0 kgf.

A relationship between a height for loading the film 18 and a height of the bobbin TB will be explained.

The position for loading the film 18 is spaced away from the winding position of the film 18 when the film 18 is to be wound around the bobbin TB. More specifically, the film 18 is loaded from the tangential direction one the bobbin TB at the same position as the maximum winding radius when all the winding layers are formed on the bobbin TB or a position away from that position.

The above-described operation is carried out in this positional relationship, so that the film 18 is positively mounted around the bobbin TB by the retaining action for the film 18, and at the same time, the simplification of the moving mechanism in the Z direction in the overall apparatus is realized. Thus, after the film 18 has been fusion-bonded to the bobbin TB, the winder 2 is rotated to carry out the winding of the film 18 (Step S11). In this case, the retainer chuck body 8 is drawn, as it is, and moved close to the winder 2 where the claw portions of the chuck 14 is released (Step S12).

Then, the retainer chuck body 8 is automatically moved in the direction X1 toward the cutter 12 by the action of the weight 8 but stops without any shock at a predetermined position by the action of the air absorber 36.

Subsequently, the welder 10 is raised and the film 18 is fusion-bonded to the bobbin TB (Step S13). Through the foregoing steps, one layer of the film 18 is wound around and fixed to the bobbin TB.

Subsequently, after the wire has been wound (Step S14), the operation is returned back to the Step S1 in FIG. 2 and the next layer film 18 will be loaded.

Figure 2:
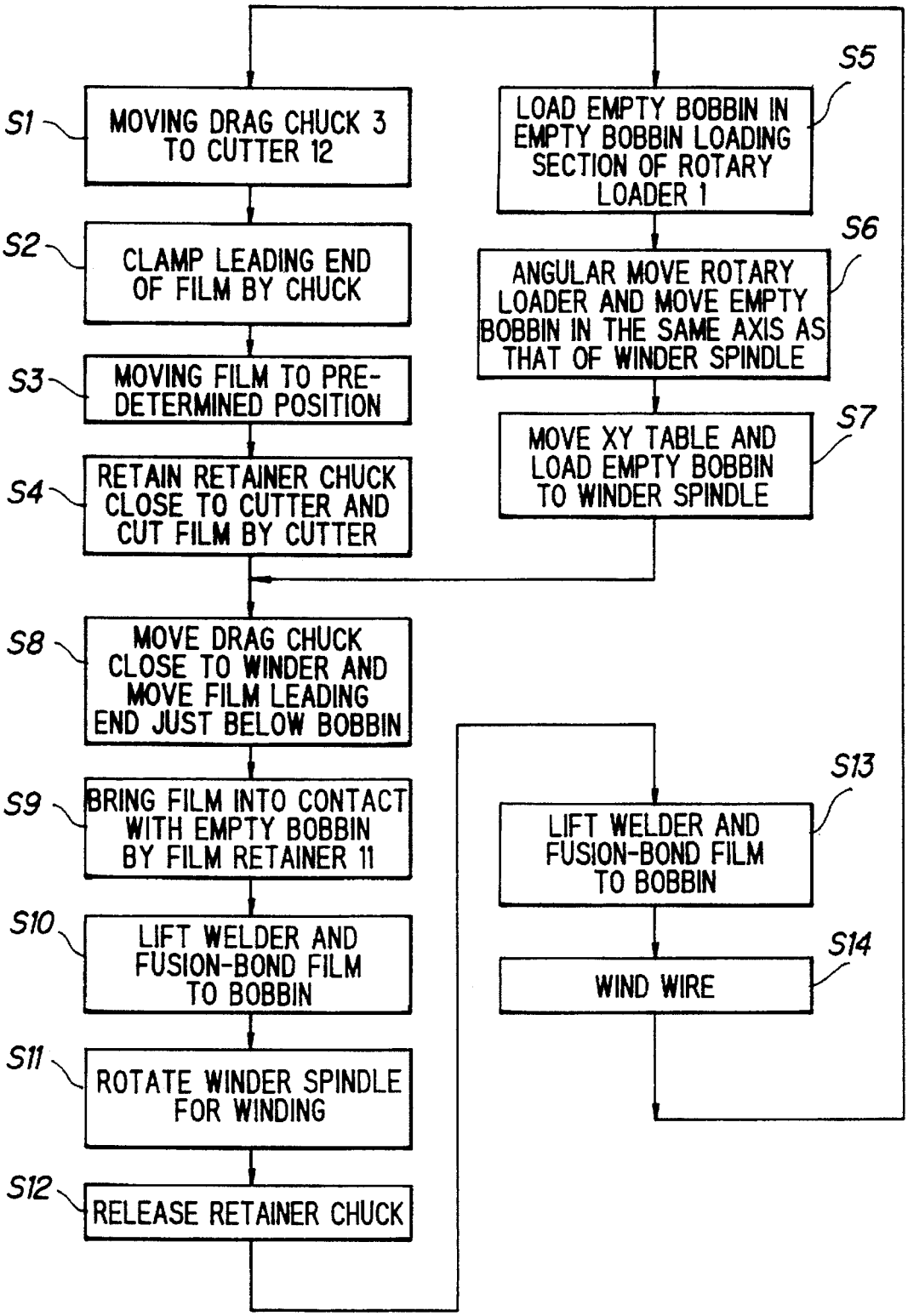
FIG. 2 is a flowchart showing a winding method of the winding apparatus according to the present invention.

Then, when the full winding for one bobbin TB is completed, the XY table shown in FIG. 2 is moved and the bobbin TB is moved to the full bobbin loading section of the rotary loader 1. At the same time, the rotary loader 1 is angularly moved to the original position and the operator may remove the full bobbin TB. Then, the operation is returned back to the Step S5 and the film 18 and the wire are wound around a next empty bobbin TB.

Through the above-described step, the winding of the wire and the winding of the film for insulating the layers of the wire are alternatively formed with precision to form multiple layers when the bobbin type transformer is formed. As a result, the manufacture of the single transformer is completed.

In the case where the wire and the film are alternatively wound around the transformer by using the above-described apparatus to form multiple layers, the wire is hooked at a wire hook portion which is formed on the film and referred to as a punch. However, if the wire is not hooked at the punch (if a punch error occurs), the wires are short-circuited so that it would be impossible to ensure design performance which is expected for the transformer.

There are three methods for determining whether or not the wire is hooked at the punch. According to a first method, the wire winding step and the film winding step are separated and these sections are connected by a conveyor or the like. Then, manual inspection is carried out during the circulation between the wire winding section and the film winding section. By a second method, after the completion of the wire winding step, the inspection is carried out through an image processing system. By a third method, after the production, the winding angle of the wire between the hook pin and the punch is visually judged.

However, in first method large scale equipment is required and manual work is required for inspection. Also, in the second method, the image processing system is expensive and installation space is required for components such as a camera, a light source and the like. Furthermore, in the third method visual inspection is required for every article.

Accordingly, it is desirable that the following inspection system be used to determine whether or not the wire is hooked at the wire hook portion, for avoiding a possible short-circuit.

A structure of a wire feeding section 171 will be described with reference to FIG. 11.

The wire feed section 171 is composed of a wire feed post 170 and a nozzle base 407. The wire feed post 170 includes therein a mechanism for operating the nozzle base 407. The wire feed post 170 is located adjacent to the XY table 9.

A nozzle base servo motor 172 is a power source for driving the nozzle base 407 and its operation is controlled by the numerical controller 19.

A ball screw 173 is fixed to a drive shaft of the servo motor 172 and is rotatably supported vertically within the wire feed post 170. A nut 174 is threadedly engaged with the ball screw 173. The nut 174 is moved up and down by the rotation of the ball screw 173.

The nozzle base 407 is a planar base which is slidable up and down along the wire feed post 170. A nut 174 is fixed to a back surface of the nozzle base 407. Accordingly, the nozzle base 407 is moved up and down by the rotation of the servo motor 172.

A wire feed nozzle 404 is used to feed the wire to a predetermined position for an empty bobbin TB for wire winding. The wire is fed out from a wire feeding winder (not shown).

A laser sensor 408 used as a detecting means emits a laser beam and receives a reflective beam from an object for detecting whether the reflective beam is present or not.

Figure 12:
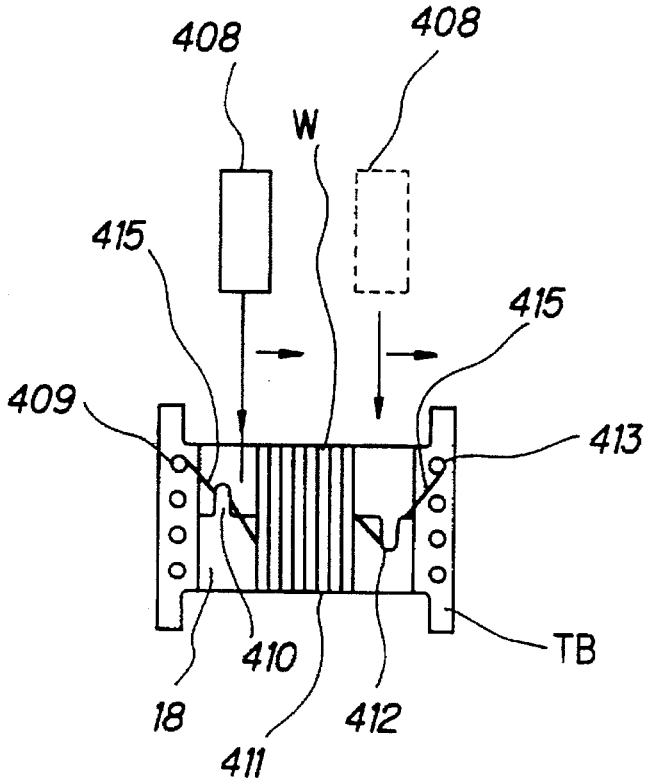
FIG. 12 is a view showing punches (wire hook portions) of the film wound around the bobbin, and the wire and the scanning of the laser sensor.
Figure 13:
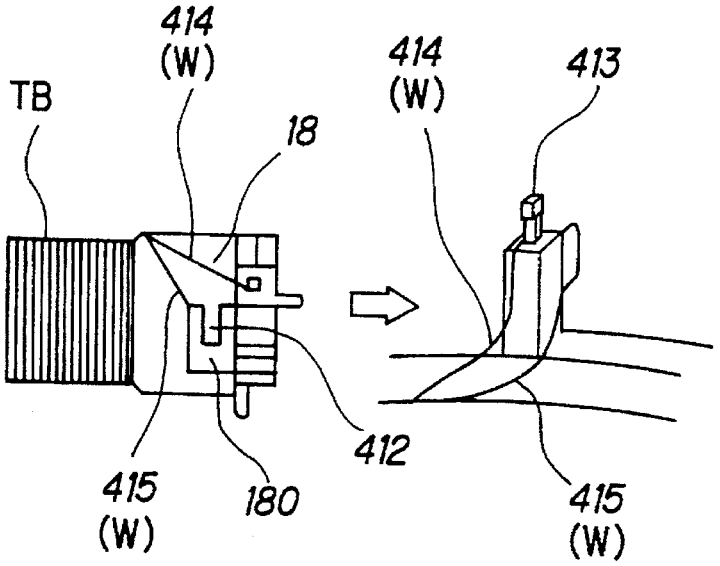
FIG. 13 is a combined view showing the wire (normal route) hooked at the punch of the film, and the wire (abnormal route) which is not hooked at the punch of the film.

A film puncher 150 shown in FIG. 1 will now be described. The film puncher 150 shown in FIG. 1 is provided on the base B in the introduction direction of the film 18 upstream of the cutter 12 shown in FIG. 1 for forming punches 410 and 412, as shown in FIGS. 12 and 13, on the film 18. The punches 410 and 412 are used as wire hook portions for hooking the wire W to the film 18.

Figure 16:
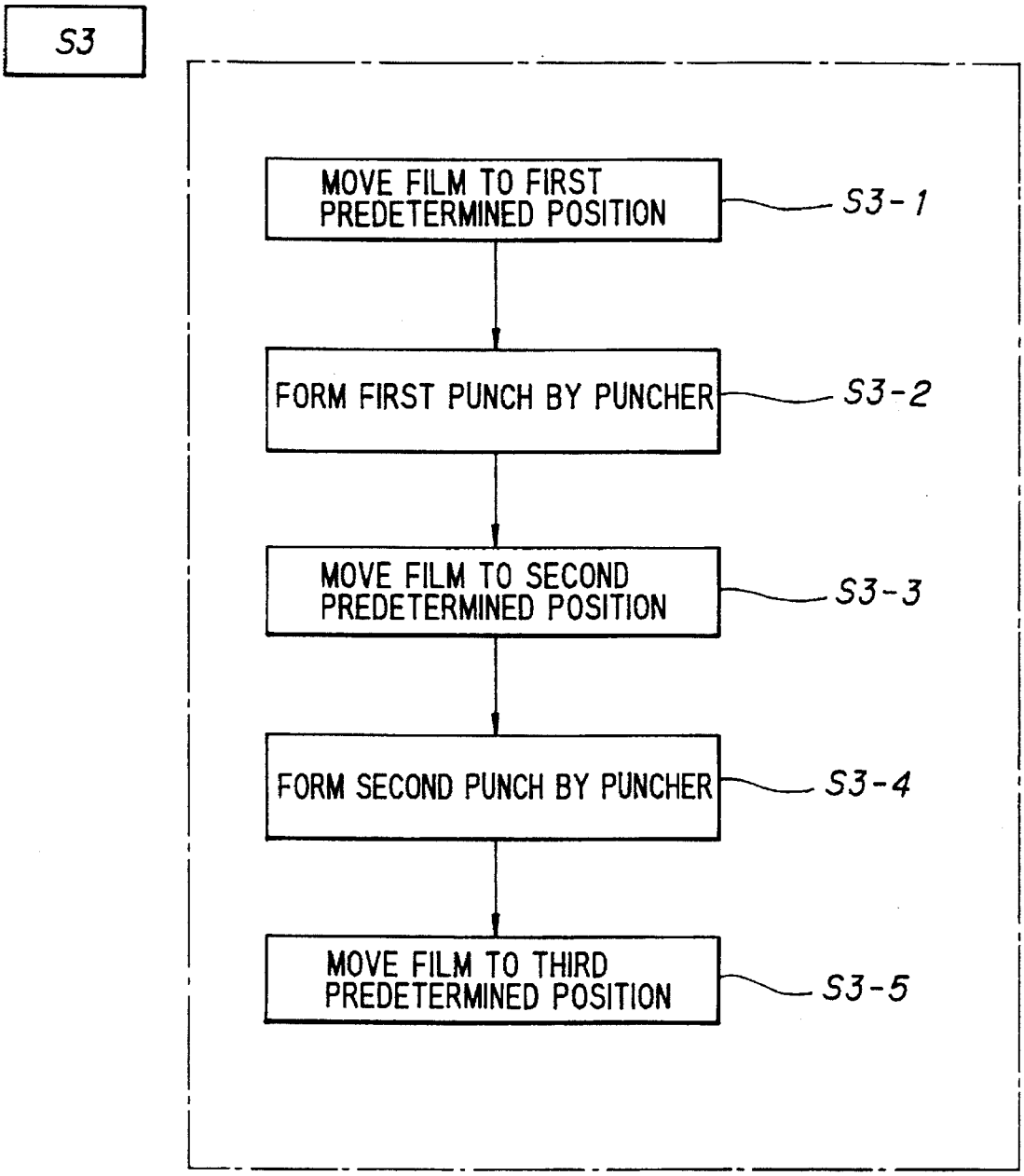
FIG. 16 is a flowchart showing the steps for forming the punches in the film.

The operation for forming the punches 410 and 412 in the film 18 will now be described with reference to FIG. 16. FIG. 16 shows a portion of the step S3 of FIG. 2 in more detail. The drag chuck body 3 shown in FIG. 1 is moved to a first predetermined position (Step S3-1). The first predetermined position means a position where the punch forming section of the film puncher 150 forms the punch at the film winding start position. Then, the first punch is formed by the puncher 150 (Step S3-2). The drag chuck body 3 shown in FIG. 1 is further moved to a second predetermined position (Step S3-3). The second predetermined position means a position where the punch to be used for hooking the winding end of the wire may be formed. Then, the second punch is formed by the puncher (Step S3-4).

Subsequently, the drag chuck body 3 is moved to a third predetermined position (Step S3-5). The third predetermined position means a position where each distance between the cutting position of the cutter 12 and the leading end of the film 18 drawn by the drag chuck body 3 is equal to a length of the film required for winding the film winding layer from the leading end. Accordingly, since the length and distance are changed for every layer, the first, second and third predetermined positions are changed for every operation.

The winding arrangement to be inspected in the bobbin TB will now be described with reference to FIGS. 12 and 13. FIG. 12 shows a winding arrangement of the bobbin TB when the winding layer is completed. Also, FIG. 13 shows an example of the state 415 where the wire W is hooked along the normal route, and an example of the state 414 where the wire is not correctly hooked along the normal route.

The wire W should be wound to pass along the normal rout 415 at the punch 412 of the bobbin TB shown in FIG. 13. However, sometimes, the wire passes through the abnormal route if there is failure in winding. The abnormal route 414 is the case where the wire W is entrained to raise the punch 412. In the abnormal state 414, the wire W is wound without hooking at the punch 412.

The method for inspection will now be described with reference to FIG. 14. As described above, the right side of FIG. 14 shows the wire W which has passed through the abnormal route and the left side of FIG. 14 shows the wire W which has passed through the normal route 415. The left side of FIG. 14 shows the normal winding shape, in which the wire W is normally hooked at the punch 410 (or 412).

Figure 14:
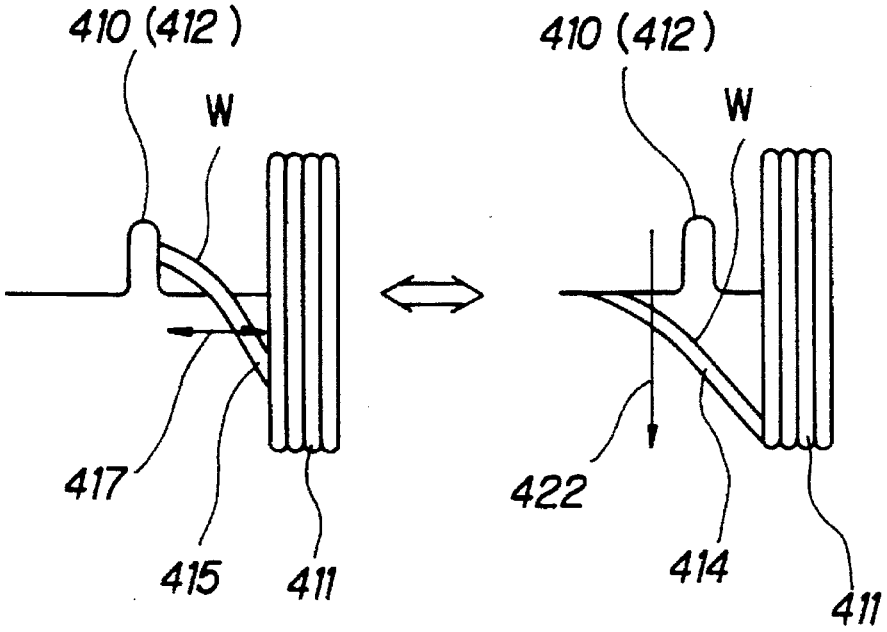
FIG. 14 is a combined view showing the laser beam inspection for the wire (normal route) hooked at the punch of the film, and the wire (abnormal route) which is not hooked at the punch of the film.
Figure 15:
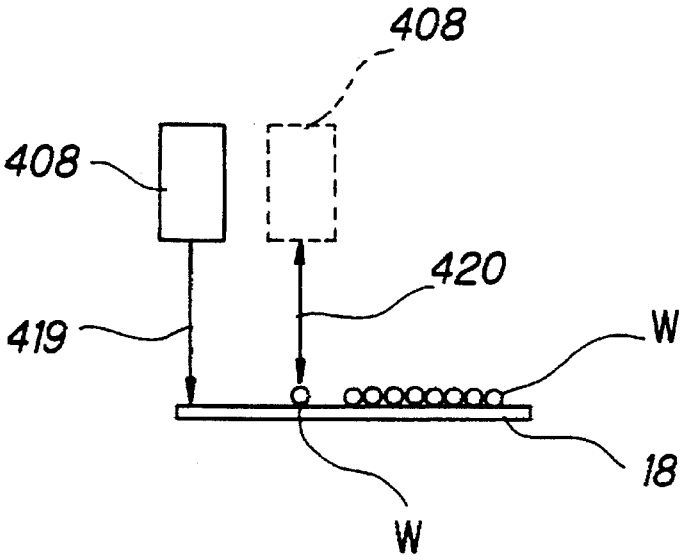
FIG. 15 is a view showing the laser beam inspection of the wire on the film.

A scanning range 417 shown in the left side of FIG. 14 corresponds to a scanning range of the laser sensor 408 shown in FIGS. 12 and 15. In case of the left side of FIG. 14, it is possible to detect the wire W normally hooked at the punch 410 (412) in a portion just below the punch 410 (or 412) by the laser sensor 408 in the scanning range 417.

In contrast, in case of the right side of FIG. 14 which shows the failure in winding, the laser sensor 408 could not detect the wire W in the scanning range 417. Thus, it is possible to readily judge the normality or abnormality of the winding shape of the wire W by scanning the laser sensor 408 relative to the bobbin TB. The relative motion between the laser sensor 408 and the bobbin TB may be carried out by operating the servo motor 403 of the XY table 9 shown in FIG. 11. More specifically, the bobbin TB is moved in its axial direction (i.e., Y direction) to thereby attain the relative motion between the sensor 408 and the bobbin TB.

Figure 17:
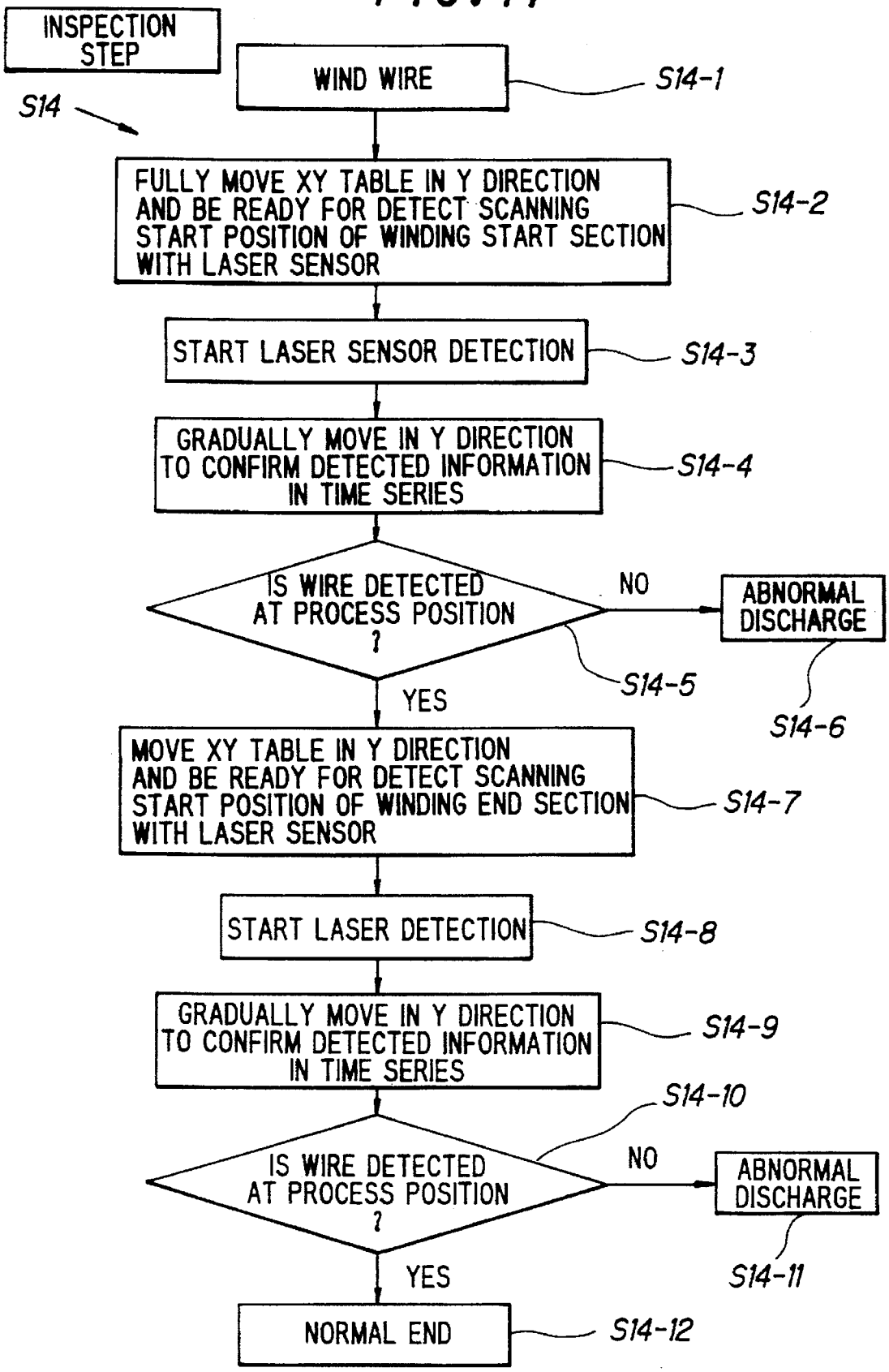
FIG. 17 is a flowchart showing the inspection steps for the wire in the film on the bobbin.

The inspection method of the winding arrangement of the wire W in the bobbin TB will now be described with reference to FIG. 17 in more detail. FIG. 17 shows the inspection steps which are to be carried out upon the completion of the wire winding steps. Accordingly, the specific inspection is started after the wire winding step (Step S14-1) corresponding to the wire winding Step S14 has been completed.

Figure 11:
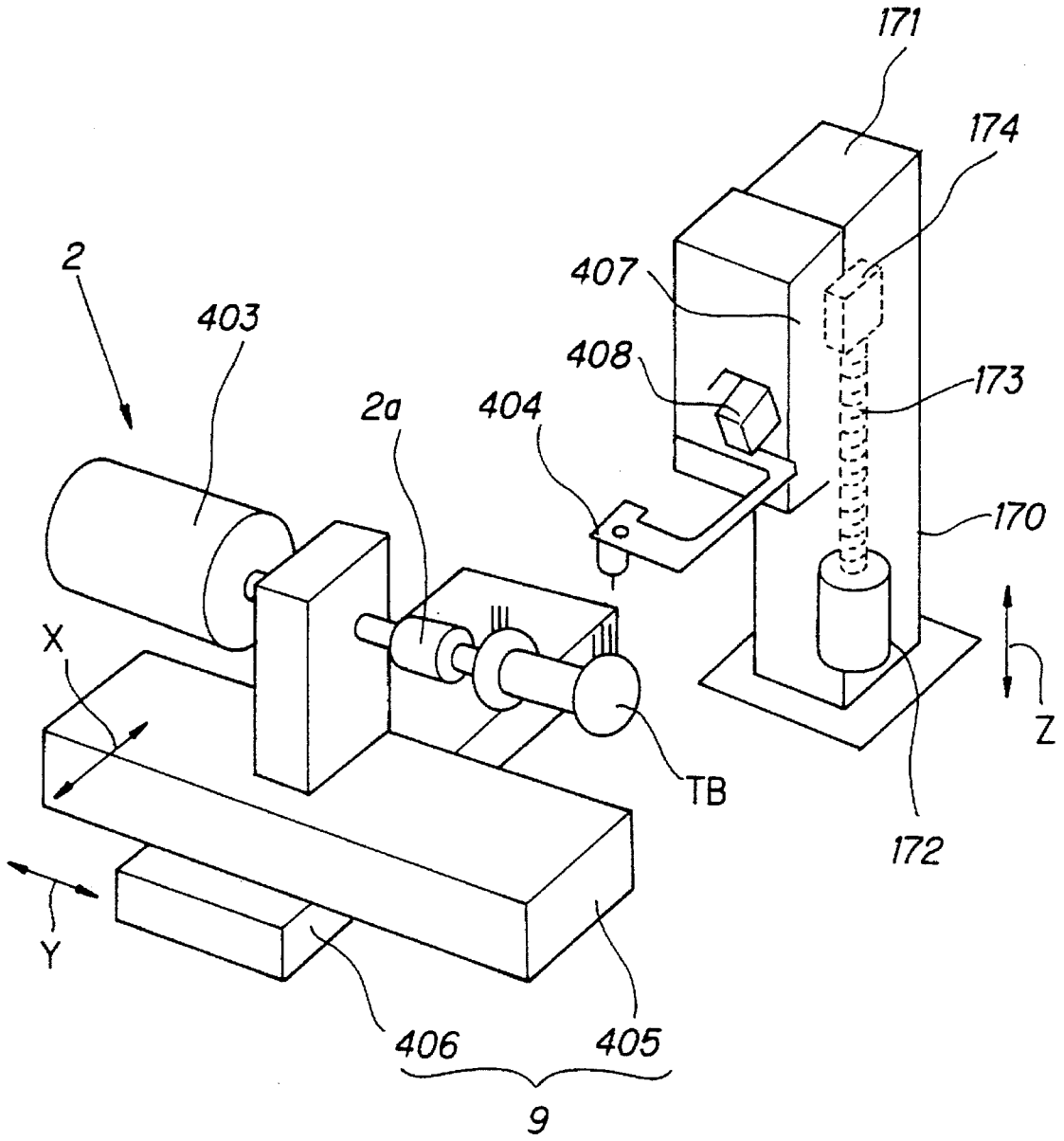
FIG. 11 is a perspective view showing an inspection system for the winding apparatus according to a preferred embodiment of the invention, and showing a wire feeding mechanism and a winder.

First of all the XY table 9 of FIG. 11 is fully moved in the Y plus direction and the laser sensor 408 shown in FIG. 12 is moved so that the laser beam 419 shown in FIG. 15 is projected to the scanning start position of the winding start section (Step S14-2). Subsequently, the laser sensor 408 is operated (Step S14-3). Then, the XY table 9 shown in FIG. 11 is gradually moved in the Y minus direction and the detection signals based upon the reflected beam 420 of FIG. 15 from the light receiving portion of the laser sensor 408 are obtained in sequence through the numerical controller 19 (Step S14-4).

Thus, the scanning operation of the laser beam is carried out in the inspection range 417. Accordingly, it is confirmed whether the wire W is detected in the scanning step or not (Step S14-5). If the wire W is not detected, it is determined that the bobbin TB is abnormal and discharged (Step 14-6).

On the other hand, if the wire W is detected in the scanning step, the winding posture is correct and, the XY table 9 is further moved in the Y minus direction to detect the scanning start position of the winding end portion with the laser sensor 408 (Step S14-7). Then, the laser beam detection is again started (Step S14-8).

Thus, the XY table 9 is gradually moved in the Y minus direction, and the confirmation step (Step S14-9) where the detection information is confirmed in sequence through the numerical controller 19 is carried out during the gradual movement of the XY table 9. Then, it is confirmed whether or not the wire W is detected or not (Step S14-10). If the wire is not detected, it is determined that the shape of the wire winding is abnormal. In this case, the bobbin TB is abnormal and discharged (Step S14-11). On the other hand, if the wire W is detected, the shape of the wire winding is normal and the steps are normally completed (Step S14-12).

In order to wind the wire W around the bobbin TB, as shown in FIG. 11, the winder 2 has a spindle **2*a* for rotating the bobbin TB and a servo motor (or stepping motor) 403 for rotating the spindle. Also, three-dimensional movement is attained for the winding nozzle 404 and the winding process (hooking winding, spindle winding, punch hooking) as follows. As shown in FIG. 11, the XY table 9 of the winder 2 has an X axis table 406 (which is provided with a guide device using a servo motor or stepping motor and a ball screw shaft) and a Y axis table 405 (which is provided with a guide device using a servo motor or stepping motor and a ball screw shaft). In addition, the nozzle base 407 is movable in the Z axis direction. The nozzle base 407 is moved by a servo motor 172**.

The invention is not limited to the foregoing arrangement. It is possible to fix the laser sensor 408 in place and to move the bobbin TB in the X, Y and Z axis direction or it is possible to fix the bobbin TB and to move the laser sensor 408 in the X, Y and Z axis direction. In any case, if the bobbin TB and the laser sensor 408 may be moved relative to each other, it is possible to carry out the fault inspection of the winding shape of the wire W by the existence of the wire W in the scanning range shown in FIG. 14. For instance, it is possible to use a laser beam type photosensitive sensor or a laser beam type shift sensor as the laser beam sensor 408.

The wiring route in the winding process for a laminated film is as follows. After the wire W is hooked at the pin 409 under the condition that the insulating film 18 is wound around the bobbin TB, the wire is hooked at the left side punch 410 formed in the insulating film 18 and the spindle winding 411 shown in FIG. 12 is used. Further, the wire W is hooked at the right side punch 412 and then the wire is hooked at the right side pin 413. In this case, if the winding arrangement of the wire W is in the normal route state 415, there is no problem. However, if there has been a punch error and the wire W is in the abnormal route state 414, the insulation between the wires is not ensured.

As described above, the detection of the punch error may be attained by the scanning operation of the laser sensor 408 of FIG. 12 at the position toward the spindle winding 411 and close to the punches 410 and 412. The punch error inspection is carried out for every layer of the wires to be laminated. A distance between the laser sensor 408 and the laminated film 18 is kept constant by controlling the height in the Z direction.

Another example may be used for the inspection system.

Unlike the foregoing inspection process, the case where the wire is not hooked at the punch 412 in the scanning range 422 as shown in the right side of FIG. 14 is detected for the punch error inspection (i.e., abnormal route state 414). The detection timing in this system is the same as that of the foregoing embodiment. The spindle 2 of FIG. 11 is rotated by the motor 403 for scanning.

In this case, the case where the wire W is present in the inspection range is regarded as the abnormal route. The inspection is carried out for every laminated layer. Since the punch position is expanded in the radially outward direction for every laminated winding, the nozzle base is raised corresponding to one layer by driving the servo motor of the wire winding section. Thus, the focus of the laser beam projection is adjusted for every layer and the laser beam is always projected to the punch portion.

Thus, with such an additional inspection system, it is possible to detect, with precision, the punch error in the winding arrangement in the inspection step to be carried out after the completion of each winding step and to avoid fault in the winding arrangement, and it is possible to carry out the inspection without any large-scale subsystem, cost, time and work. It is also possible to detect the cause of the fault immediately after the occurrence of the fault since the inspection is carried out for every layer. This makes it possible to avoid excess time and cost.

The present invention is not limited to the specific embodiment. For instance, the invention may be applied to any other windings than the flyback transformer.

What we claim is:

1. A winding apparatus for alternately winding a wire and a film to form a multiplicity of layers around a bobbin of a bobbin type transformer, comprising:

film loading means for holding a predetermined length of the film at a film loading position away from a winding position of the film before the film is wound around the bobbin and including a drag chuck for holding a leading end of the predetermined length of the film and a retaining chuck for holding a rear end of the predetermined length of the film;

film retainer means for pressing a leading end of the film being held by said drag chuck into contact with the bobbin;

an X-Y table mechanism movable in two mutually perpendicular directions on a horizontal planar surface;

a winder mounted on said table mechanism for rotating the bobbin and winding the film and the wire around the bobbin; and a wire feed mechanism arranged adjacent said X-Y table mechanism for feeding the wire to the bobbin rotated by said winder;

wherein when the bobbin is mounted on said winder and the wire is fed from said wire feed mechanism, said winder is rotated, and said table mechanism incrementally moves for every turn of the wire around the bobbin.

2. The winding apparatus according to claim 1, wherein the film loading means further includes:

drag chuck drive means for driving said drag chuck toward said bobbin and for drawing the film in a loading direction toward said loading position, so that said film retainer means presses the leading end into the contact with the bobbin;

film cutting means for cutting the film to the predetermined length, whereby said retaining chuck holds the rear end of the film which has been cut by said cutting means.

3. The winding apparatus according to claim 2, wherein said drag chuck drive means comprises a servo motor, and wherein said film loading means further includes a biasing means for biasing said retaining chuck in a direction opposite to said loading direction and maintaining the predetermined length of film in tension.

4. The winding apparatus according to claim 1, wherein said film retainer means comprises a film pressure block for pressing the leading end of the film against the bobbin, and pressure control means for controlling an amount of pressure exerted on the film against the bobbin by said film pressure block.

5. A method for alternately winding a wire and a film to form a multiplicity of layers around a bobbin of a bobbin type transformer, comprising the steps of:

guiding the film to a loading position spaced away from a winding position of the film;

holding a leading end of the film with a drag chuck;

drawing a predetermined length of film toward the bobbin;

holding a rear end of the film with a retaining chuck;

cutting the film at the retaining chuck and forming a strip of film having the predetermined length;

moving the drag chuck holding the leading end of the film from said loading position to said winding position so that the leading end of the film is pressed into contact with the bobbin;

mounting a winder on an X-Y table mechanism that is movable in two mutually perpendicular directions on a horizontal planar surface;

mounting the bobbin on the winder;

feeding the wire to the bobbin from a wire feed mechanism arranged adjacent the X-Y table mechanism;

rotating the bobbin by means of the winder;

winding the film and the wire around the bobbin; and incrementally moving the X-Y table mechanism for every turn of the wire around the bobbin.

* * * * *